United States Patent [19]

Toshimitsu

[11] Patent Number: 4,550,334

[45] Date of Patent: Oct. 29, 1985

[54] METHOD FOR FORMING AN IMAGE BY THE USE OF AN IMAGE CARRIER

[75] Inventor: Kenshi Toshimitsu, Yokohama, Japan

[73] Assignee: Tokyo Shibaura Denki Kabushiki Kaisha, Kawasaki, Japan

[21] Appl. No.: 575,388

[22] Filed: Jan. 30, 1984

[30] Foreign Application Priority Data

Jan. 31, 1983 [JP] Japan ..... 58-13998

[51] Int. Cl.[4] ..... G03G 15/00

[52] U.S. Cl. ..... 355/3 R; 430/31

[58] Field of Search ..... 355/3 R, 77, 3 CH, 14 CH, 355/15; 430/31, 902

[56] References Cited

U.S. PATENT DOCUMENTS

| | | | |
|---|---|---|---|
| 2,845,348 | 7/1958 | Kallman | 430/902 |
| 4,121,947 | 10/1978 | Hemphill | 355/15 |
| 4,372,669 | 2/1983 | Fantuzzo et al. | 355/15 |

*Primary Examiner*—A. T. Grimley
*Assistant Examiner*—David Warren
*Attorney, Agent, or Firm*—Cushman, Darby & Cushman

[57] ABSTRACT

Disclosed is a method for forming an image on an image carrier whose resistance is changed by exposure. The method of the invention comprises an exposure process for exposing the image carrier, a charging process for charging the exposed portion to form an electrostatic latent image thereon, and a developing process for developing the electrostatic latent image. These processes are executed in the order named. In the exposure process, the resistance of the image carrier changes according to the quantity of light applied thereto. When the image carrier is then charged, therefore, the electrostatic latent image is formed thereon. According to the method of the invention, the developing process directly follows the charging process, so that the image carrier holds electric charges for only a short time.

6 Claims, 6 Drawing Figures

METHOD FOR FORMING AN IMAGE BY THE USE OF AN IMAGE CARRIER

BACKGROUND OF THE INVENTION

The present invention relates to a method for forming a latent image on an image carrier in an image forming apparatus, such as an electronic copying machine or printer.

In copying a document or original on an electronic copying machine, for example, a latent image of the original is formed on the surface of a photosensitive member in the copying machine. Conventional methods of latent image formation include the following system. First, as shown in FIG. 1, the surface of a photosensitive member 2 is substantially and uniformly charged by a charging unit 4. Then, a light beam 6 reflected by an original is projected on the charged surface of the photosensitive member 2 to form an electrostatic latent image thereon. Thereafter, toner is electrostatically attached to the electrostatic latent image by a developing unit 8 to develop the image. Namely, the conventional image forming method comprises a charging process for charging the photosensitive member 2, an exposure process for applying a light beam to the charged portion of the photosensitive member 2 to form an electrostatic latent image thereon, and a developing process for developing the electrostatic latent image, these processes being executed in the order named. This prior art method is known as an image forming process of the Carlson electrophotographic method.

According to the prior art method, however, the electric charges applied to the photosensitive member 2 in the charging process need to be held on the photosensitive member's surface until the developing process following the exposure process is reached. Therefore, the electric charges on the photosensitive member 2 must be maintained for a relatively long time. Thus, requiring a long interval between the charging and developing processes, the conventional method is subject to the following drawbacks:

1. If the electric charge holding capability of the photosensitive member is low, then it is necessary to previously supply a high voltage to the photosensitive member is consideration of a reduction of potential. Thus, the charging unit requires a large capacity.

2. If too high a voltage is previously supplied to the photosensitive member in consideration of the reduction of potential, the photosensitive layer will possibly be electrically broken.

3. Since the material of the photosensitive member needs to be high in dark resistance (approx. $10^{13}$ to $10^{14}\Omega\cdot$cm) for a prolonged hold of electric charges, it must be selected from limited kinds of materials.

Some photosensitive materials, not so high in resistance, cannot be used for this purpose, although they are excellent in sensitivity or in mechanical hardness. For example, some amorphous silicon materials are too low in dark resistance and, hence, in electric charge holding capability to be conventionally used as effective photosensitive materials for the purpose concerned.

SUMMARY OF THE INVENTION

The object of the present invention is to provide an image forming method accommodating a short time interval between a charging process for charging a photosensitive member and a developing process for developing an electrostatic latent image formed on the photosensitive member.

According to an aspect of the present invention, there is provided, a method for forming an image on an image carrier whose resistance is changed by exposure, comprising an exposure process for exposing the image carrier on the basis of the image thereon, thereby forming a latent image in accordance with the change of the resistance corresponding to said image, a charging process for charging the image carrier after said exposure process to form an electrostatic latent image from said latent image, and a developing process for developing the electrostatic latent image formed in said charging process.

DETAILED DESCRIPTION OF THE PREFERRED EMBODIMENT

Referring now to FIGS. 2 to 6, one embodiment of the present invention will be described in detail.

Figure 1:
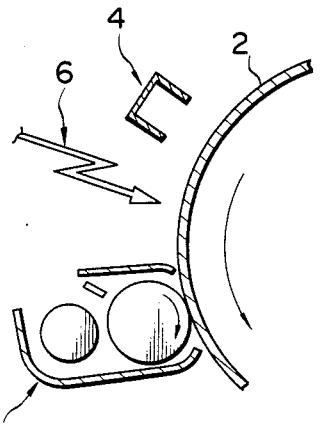
FIG. 1 PRIOR ART
FIG. 1 is a diagram for illustrating a prior art method for forming a latent image on an image carrier.
Figure 2:
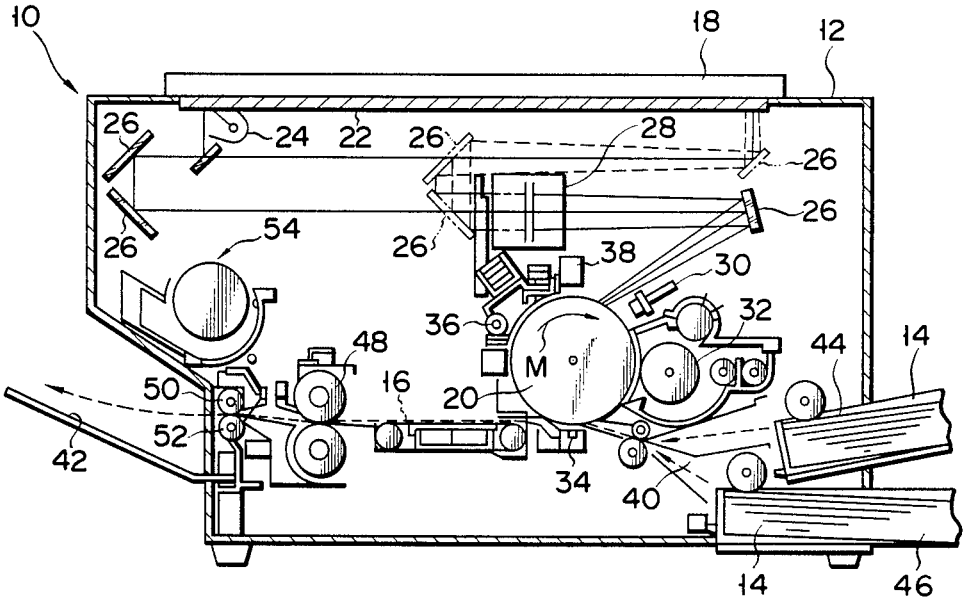
FIG. 2 is a schematic sectional view of a copying apparatus according to one embodiment of the present invention.

As shown in FIG. 2, an electronic copying apparatus 10 according to one embodiment of the invention, is provided with a housing 12. Defined in the housing 12 is a conveyor path 16 (indicated by a broken line in FIG. 2) on which copying sheets 14 are carried. Over the housing 12 lies a swingable cover 18 which holds down the original document (not shown) to be copied. A photosensitive member 20 is rotatably supported in the substanitally central portion of the interior of the housing 12. An electrostatic latent image is to be formed on the surface of the photosensitive member 20 by a light beam applied thereto. Disposed between the photosensitive member 20 and the cover 18 is an exposure mechanism for an exposure process P (see FIG. 3) for applying a light beam to the photosensitive member 20. The exposure mechanism includes an original table 22 to carry the original, a lamp 24 for irradiating the table 22, mirrors 26 for reflecting the light from the table 22 on the photosensitive member 20, and a lens unit 28 for reducing or extending images.

A charging unit 30 for a charging process Q (see FIG. 3) and a developing unit 32 for a developing process R (see FIG. 3) are successively arranged around the photosensitive member 20 along the rotating direction M thereof in the order named, starting from the position where the light from the mirrors 26 is projected. The charging unit 30 charges the surface of the photosensitive member 20 to form an electrostatic latent image thereon, while the developing unit 32 develops the electrostatic latent image on the photosensitive member 20 by attaching a toner thereto.

The developing unit 32 is followed by a transfer unit 34 for a transfer process on the copying sheet conveyor path 16, a cleaning unit 36 for a cleaning process to remove the toner on the photosensitive member 20, and a de-electrification unit 38 for a de-electrification process to discharge the electrostatic latent image on the photosensitive member 20. The transfer unit 34 moves the toner on the photosensitive member 20 to the copying sheet, thereby transferring the image on the photosensitive member 20 to the sheet.

Thus, in this embodiment, the photosensitive member 20 is surrounded by the means for the exposure process, charging process, developing process, transfer process, cleaning process, and de-electrification process, arranged in the rotating direction (M) in the order namded.

A paper feeder 40 for feeding the copying sheet to the conveyor path 16 is provided on one side of the housing 12 or at the starting end of the conveyor path 16. A receiving tray 42 to receive copied sheets is provided at the terminal end of the conveyor path 16. The paper feeder 40 is fitted with paper cassettes 44 and 46 which each store a pile of copying sheets 14. Arranged near the terminal end of the conveyor path 16 are a fixing unit 48 for fixing a toner to the copying sheet and exit rollers 50 and 52. A cooling fan unit 54 is disposed over the exit rollers 50 and 52.

Figure 3:
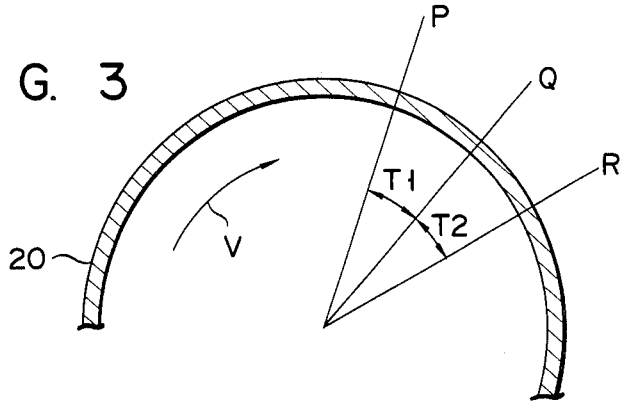
FIG. 3 is a diagram for illustrating individual processes according to the emobodiment of FIG. 2.
Figure 4:
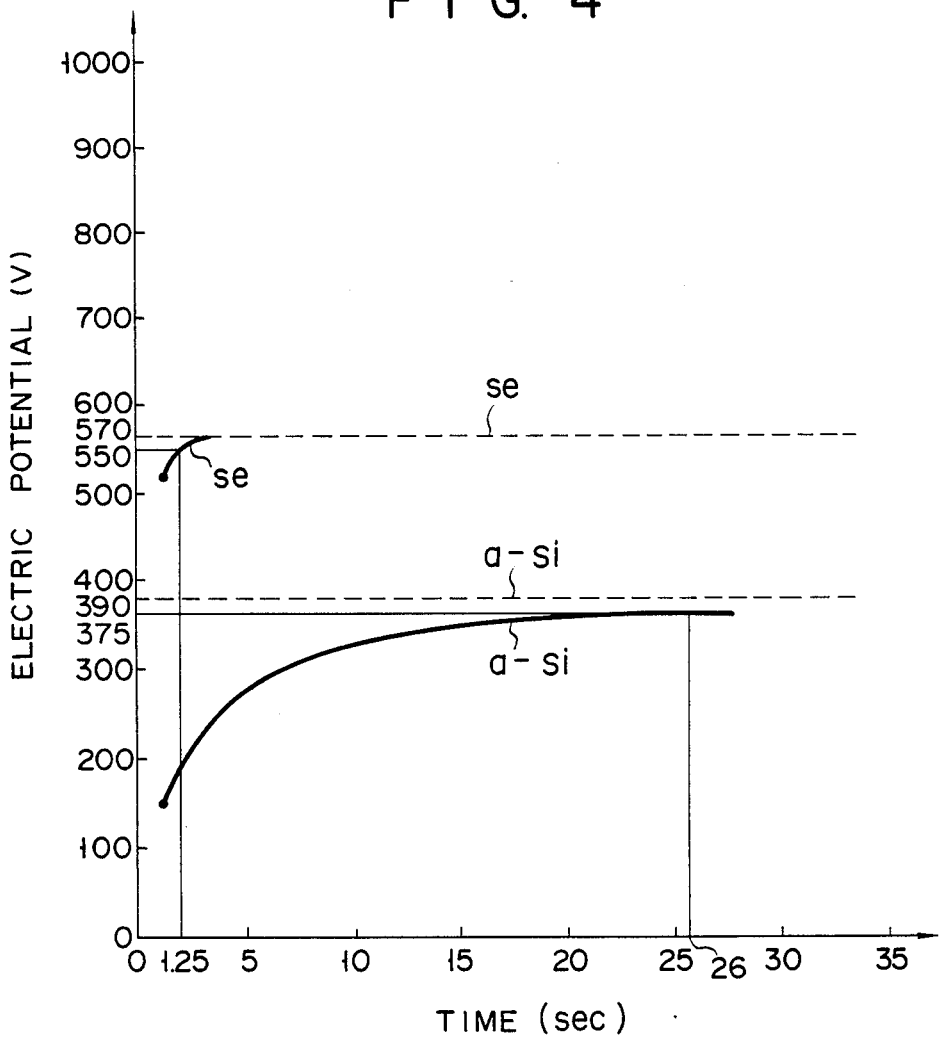
FIG. 4 shows curves illustrating the relationships between time and the resistances (electric potential) of photosensitive materials after exposure.
Figure 5:
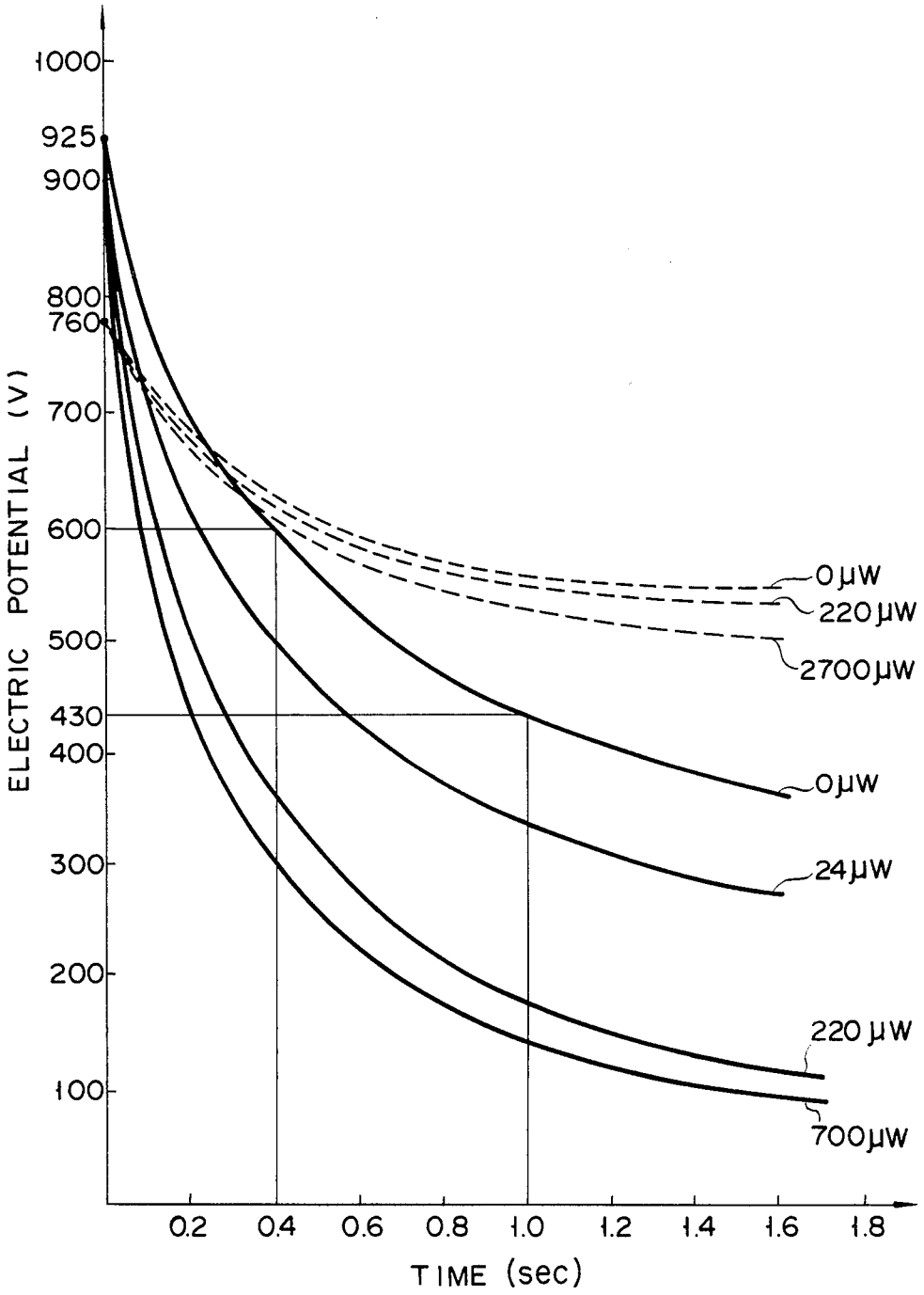
FIG. 5 shows curves illustrating the relationship between the time elapsed and the surface potentials of photosenitive members after charging.

Referring now to FIGS. 3, 4 and 5, the relationship between the exposure process P, charging process Q and developing process R will be described.

A light beam, for exposure, is applied to the photosensitive member 20 in the exposure process P. Exposed portions of any photosensitive material will undergo a reduction in resistance. If the photosensitive material is left in a dark place as it is, it will take the photosensitive material a certain time (recovery time) to recover its original resistance. As shown in FIG. 4, for example, the time required for 95% recovery of resistance is approximately 1.25 seconds for a selenium (Se) material and about 26 seconds for an amorphous silicon (a-Si) material. FIG. 4 shows curves obtained by plotting time-based electric potential measured on the a-Si material which was kept in a dark place for ten minutes, exposed to a light beam of 700 $\mu$W (relative value), and then left in the dark again and charged at predetermined intervals. A light beam of 2,700 $\mu$W was applied to the Se material in the same manner. In FIG. 4, the broken lines represent values obtained 0.8 second after charging of the a-Si and Se materials which were kept in the dark for ten minutes before being exposed. If unexposed, the photosensitive material maintains a high electric potential owing to the resistance of its own. If exposed, the photosensitive material is reduced in resistance and hence in electric potential. Since the resistance, however, is recovered as time goes by, it is indicated that the electric potential, after the lapse of time, is increased (recovered) gradually. Namely, the resistance is found to be changed by irradiation.

As shown in FIG. 5, the resistances of exposed portions of the photosensitive materials vary with the quantity of light applied. FIG. 5 shows curves obtained by plotting time-based voltages of the photosensitive materials charged after being exposed to various quantities of light. In FIG. 5, the solid lines represent values for the a-Si material, and the broken lines for the Se material.

Thus, a satisfactory electrostatic latent image can be formed on the photosensitive member by exposing the photosensitive material and then charging it before the resistance of the exposed portion thereof has recovered. Namely, the electrostatic latent image is formed on the photosensitive member by making the time interval T1 between the exposure process P and the charging process Q shorter than the light recovery time of the photosensitive material, as shown in FIG. 3. The value T1 varies with the kind of the photosensitive material. As shown in FIG. 4, for example, T1 is 1.25 seconds or less for the Se material and 26 seconds or less for the a-Si material. It is to be understood that, according to the present embodiment, the time interval T1 between the exposure and charging processes may be set to any desired value by suitably adjusting the rotating speed V of the photosensitive member 20 or the location of the exposure unit or charging unit.

The time interval T2 between the charging process Q and the developing process R is preferably made short, since the electric potential applied in the charging process Q is gradually reduced as time goes by. The value T2 varies with the kind of the photosensitive material. The voltage used in the developing process is preferably set to 500 V or thereabout. If the a-Si material is used for the photosensitive material, T2 is set between 0.4 second and 1.0 second, as shown in FIG. 5. If the time interval T2 is shortened, the voltage to be applied in the charging process can be reduced. According to the present embodiment, moreover, the time interval T2 between the charging and developing processes may be made as short as possible. Namely, the time interval T2 may be set to any desired value by suitably adjusting the rotating speed V of the photosensitive member 20 or the location of the charging unit or developing unit.

According to the present embodiment, a satisfactory latent image may be formed by suitably setting the time intervals T1 and T2, despite the use of a photosensitive material with a low dark resistance.

Since the values T1 and T2 may be set before the electric potential is lowered below a predetermined level, a transformer for supplying electricity used in the charging process may be reduced in capacity.

Since the time interval between the charging and developing processes, i.e., the electric charge holding time of the photosensitive material, can be made as short as possible, even a material with a low dark resistance (e.g., approx. $10^{13}$ $\Omega$·cm or less) may be used for the photosensitive member.

Figure 6:
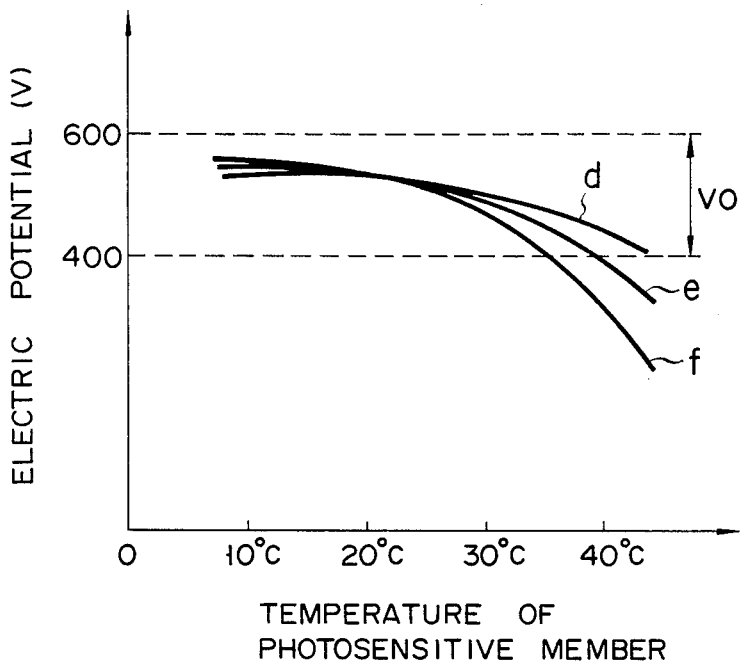
FIG. 6 shows curves illustrating the relationships between the electric potential and time-based temperature of a photosensitive member after charging.

FIG. 6 shows curves illustrating the relationships between the time lapse and the temperature of a photosensitive member after the photosensitive material is charged. Curves d, e and f are obtained by plotting the values of the temperature and electric potential of the photosensitive member when the time lapse after charging is set to 0.1, 0.2 and 0.3 seconds, respectively. Symbol $V_0$ indicates the range of voltage for stable images. It is evident from these curves that the shorter the time lapse after charging, the less the influence of temperature will be. Thus, according to the present embodiment, the time interval between the charging and developing processes is short, naturally permitting the formation of stable images.

It is to be understood that the present invention is not limited to the aforementioned embodiment, and that various changes and modifications may be effected therein by one skilled in the art without departing from the scope or spirit of the invention.

In the above embodiment, the method of the invention is applied to an electronic copying apparatus. Alternatively, however, the invention may be applied, with the same results, to a printer for forming an image which requires no half tone.

In the foregoing embodiment, a photosensitive member is used for the image carrier. The same effect may be obtained with use of materials for this purpose which are sensitive to electromagnetic waves, X-rays or gamma rays. In this case, electromagnetic waves, X-rays or gamma rays are used as exposure means.

What is claimed is:

1. A method of sequentially forming a series of images on an image carrier whose resistance is changed by exposure comprising the steps of:

exposing said image carrier with an image, thereby forming a latent image in accordance with a change of resistance;

charging said image carrier after said exposing step to form an electrostatic latent image from said latent image;

developing said electrostatic latent image formed in said charging step, the time interval between said charging and developing steps ranging from 0.4 to 1.0 seconds;

removing electric charges from said image carrier, said removing step following said developing step; and repeating said exposing, charging, developing and removing steps in the order named with respect to others of said images.

2. A method according to claim 1, wherein said image carrier is formed of a selenium material, and the time interval between said exposing and charging steps is approximately 1.25 seconds or less.

3. A method according to claim 1, wherein said image carrier is formed of an amorphous silicon material, and the time interval between said exposing and charging steps is approximately 26 seconds or less.

4. A method according to claim 1, wherein said developing step includes a step of applying a toner with electric charges of opposite polarity to that of the electric charges on the image carrier to the electrostatic latent image on the image carrier.

5. A method according to claim 4, further comprising the step of transferring toner to a sheet, said transferring step coming between said developing and removing steps.

6. A method according to claim 5, further comprising the step of removing residual toner on the electrostatic latent image, said toner removing step coming between said transferring and charge removing steps.

* * * * *